US009831622B1

(12) United States Patent
Lin

(10) Patent No.: US 9,831,622 B1
(45) Date of Patent: Nov. 28, 2017

(54) UNIVERSAL SOCKET CONVERTER WITH POWER BANK

(71) Applicant: Yuying Lin, Lufeng (CN)

(72) Inventor: Yuying Lin, Lufeng (CN)

( * ) Notice: Subject to any disclaimer, the term of this patent is extended or adjusted under 35 U.S.C. 154(b) by 0 days.

(21) Appl. No.: 15/487,579

(22) Filed: Apr. 14, 2017

(51) Int. Cl.

| | |
|---|---|
| ***H01R 27/02*** | (2006.01) |
| ***H01R 13/717*** | (2006.01) |
| ***H01R 13/66*** | (2006.01) |
| ***H01R 13/527*** | (2006.01) |
| ***H01R 13/68*** | (2011.01) |
| ***H01R 29/00*** | (2006.01) |

(52) U.S. Cl.
CPC ..... *H01R 27/02* (2013.01); *H01R 13/527* (2013.01); *H01R 13/6675* (2013.01); *H01R 13/68* (2013.01); *H01R 13/717* (2013.01); *H01R 29/00* (2013.01)

(58) Field of Classification Search
CPC .. H01R 13/68; H01R 13/527; H01R 13/6453; H01R 13/6675; H01R 27/02; H01R 29/00
USPC ..... 439/222, 170–174, 620.21
See application file for complete search history.

(56) References Cited

U.S. PATENT DOCUMENTS 2,163,201 A * 6/1939 Kalencik ..... H01R 27/00 439/172
3,025,486 A * 3/1962 Falconer ..... H01R 27/00 439/103
4,626,052 A * 12/1986 Rumble ..... H01R 31/06 439/173
6,062,880 A * 5/2000 Skuza ..... H01R 24/68 439/131
6,923,666 B1 * 8/2005 Liao ..... H01R 31/06 439/131
7,445,513 B1 * 11/2008 Lee ..... H01R 31/06 439/131
8,382,493 B2 * 2/2013 Ruffner ..... H01R 27/00 439/105
9,083,125 B2 * 7/2015 Rogers ..... H01R 27/00

* cited by examiner

*Primary Examiner* — Tulsidas C Patel
*Assistant Examiner* — Travis Chambers
(74) *Attorney, Agent, or Firm* — Maier & Maier, PLLC

(57) ABSTRACT

The present disclosure discloses a universal socket converter with power bank, including a housing, wherein the front of the housing is provided with a USB power jack, a universal power jack and an indicator light, the upper and lower ends of the back of the housing are respectively provided with a retractable power-taking plug, the middle part of the back of the housing is provided with a foldable power-taking plug; the inside of the housing is provided with a circuit board and a storage battery, wherein the circuit board is provided with a USB power socket and an integrated universal power socket, wherein the USB power socket and the integrated universal power socket are provided with conductors inside, wherein the conductors are connected with the circuit board, the circuit board is connected with the storage battery, the retractable power-taking plug and the foldable power-taking plug.

11 Claims, 8 Drawing Sheets

UNIVERSAL SOCKET CONVERTER WITH POWER BANK

TECHNICAL FIELD

The present disclosure relates to a socket converter, particularly relates to a universal socket converter with power bank.

BACKGROUND TECHNOLOGY

At present, the socket converter on the market is provided with less standard sockets, wherein the conductors are iron, and the conductivity is not strong, USB and power bank are not provided in the socket converter, the socket converter cannot be used anywhere and anytime, and cannot provide maximum convenience for the users. Using the retractable power-taking plug and the foldable power-taking plug on the market at the same time has security risks.

SUMMARY OF THE INVENTION

To solve the above problems, the present disclosure provides a universal socket converter with power bank.

In order to achieve the above object, the present disclosure uses technical solutions below:

A universal socket converter with power bank, includes a housing, wherein the front of the housing is provided with a USB power jack, a universal power jack and an indicator light, the upper and lower ends of the back of the housing are respectively provided with a retractable power-taking plug, the middle part of the back of the housing is provided with a foldable power-taking plug; the inside of the housing is provided with a circuit board and a storage battery, wherein the circuit board is provided with a USB power socket and an integrated universal power socket, wherein the USB power socket and the integrated universal power socket are provided with conductors inside, wherein the conductors are connected with the circuit board, the circuit board is connected with the storage battery, the retractable power-taking plug and the foldable power-taking plug.

The universal socket converter with power bank also includes a built-in slider which is located between the circuit board and the housing, when the retractable power-taking plug is pushed out, another retractable power-taking plug will be locked so that cannot be pushed out and moved to the contact circuit.

The universal power jacks include British standard socket, Australian standard socket, European standard socket and American standard socket.

The power-taking plug includes British standard plug, Australian standard plug and European standard plug.

The housing is made from flame retardant material, wherein the flame retardant material is PC (Poly Carbonate) material.

The conductor is made from brass.

A fuse is set between the circuit board and the power-taking plug.

There are two USB power jacks, one is 1.5 A, the other one is 2.1 A.

The retractable power-taking plug or the foldable power-taking plug are made from nickel plated copper.

The circuit board is provided with three smart ICs, used to prevent overcurrent, overcharge, overload, overvoltage, short circuit, and high temperature.

The present disclosure has advantages in comparison with the prior art: the present disclosure assembles plugs and sockets of the most common standards in global, which can be connected with plugs of a variety of national standards; Fuse is set inside, and it is safety for use electricity; The housing is made of fire-retardant materials, and will not combust at high temperature; Meanwhile the conductors inside are made of brass, having strong conductivity. Dual USB interfaces are provided at the same time, and power bank is provided inside, so it can be charged at any time; preventing overcurrent, overcharge, overload, overvoltage, short circuit, and high temperature. When one of the retractable power-taking plug and folding power-taking plug is pushed out, other plugs will be locked automatically and they cannot be pushed out and moved to the contact circuit, avoiding security risks from operation errors.

DETAILED DESCRIPTION

The present disclosure will now be further described with reference to the accompanying drawings.

Figure 1:
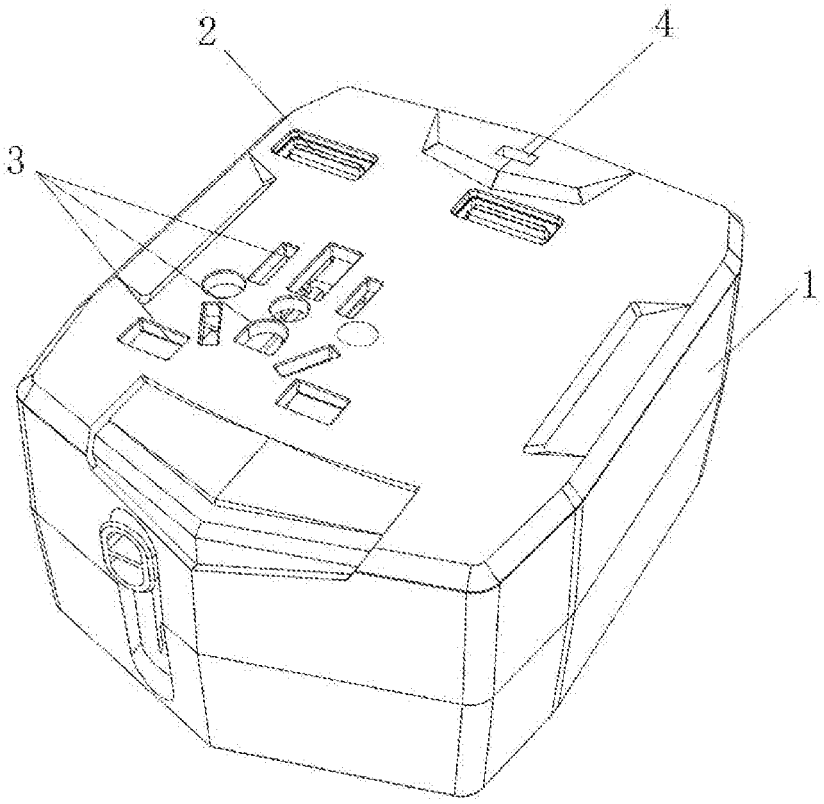
FIG. 1 is a structural diagram of the front of the present disclosure.
Figure 2:
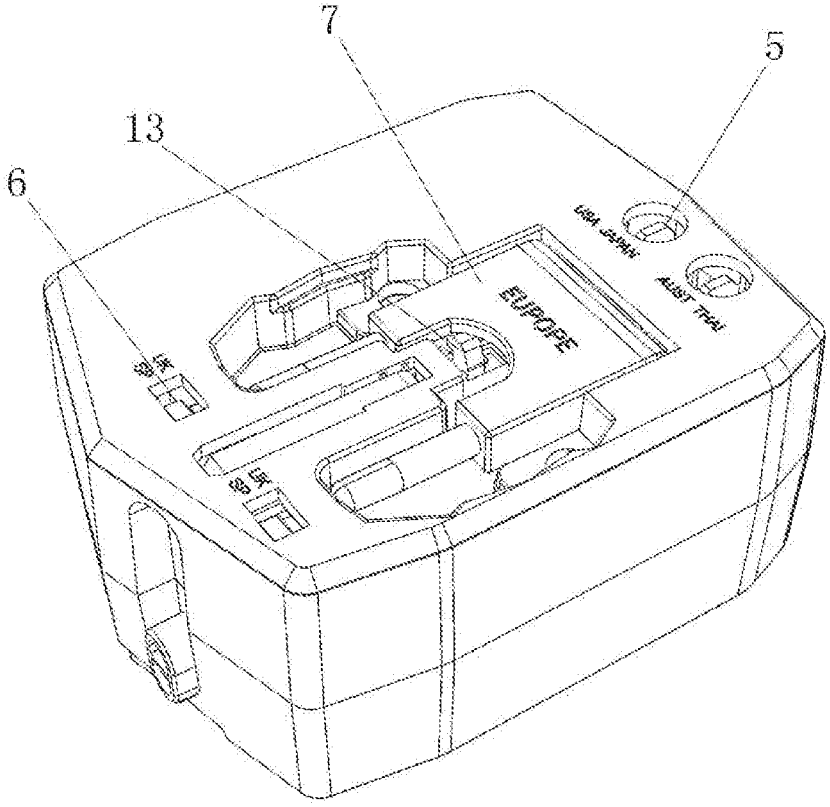
FIG. 2 is a structural diagram of the back of the present disclosure.
Figure 3:
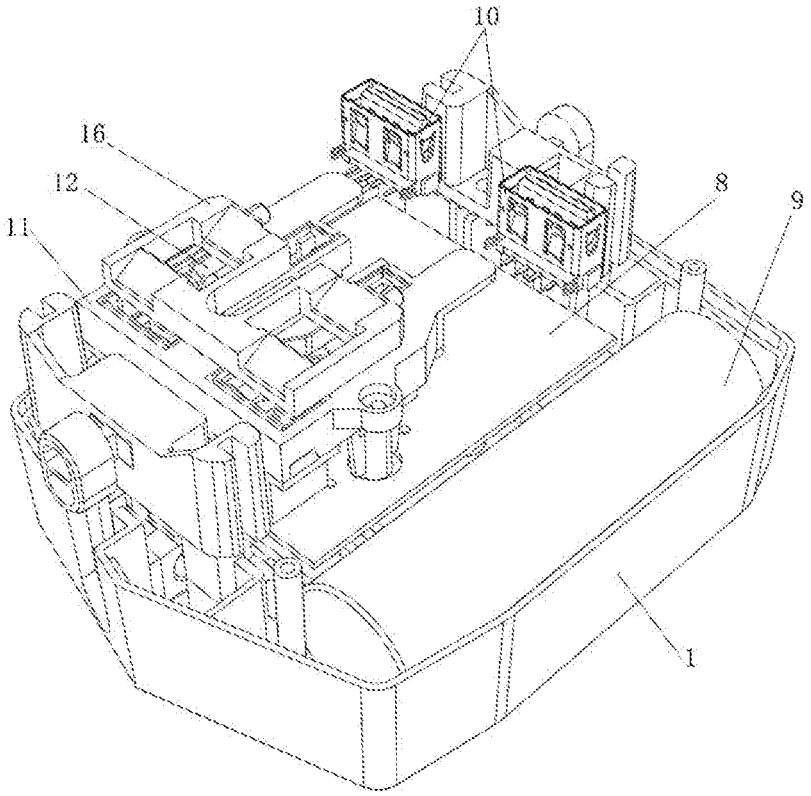
FIG. 3 is a structural diagram of the inside of the front of the present disclosure.
Figure 4:
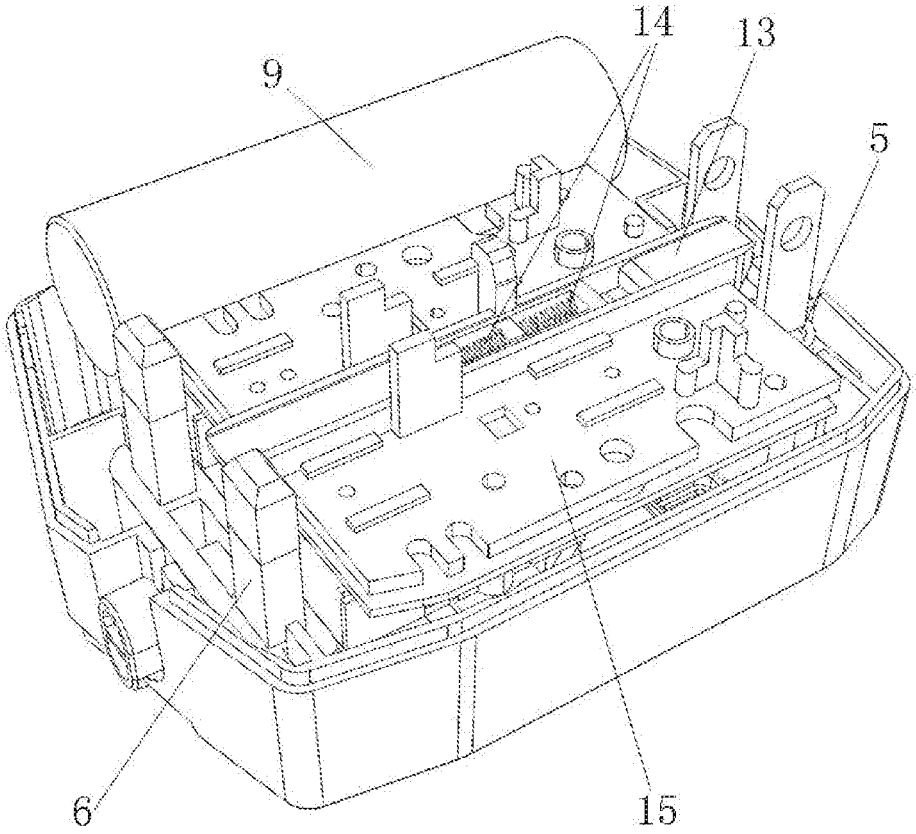
FIG. 4 is a structural diagram of the inside of the back of the present disclosure.
Figure 5:
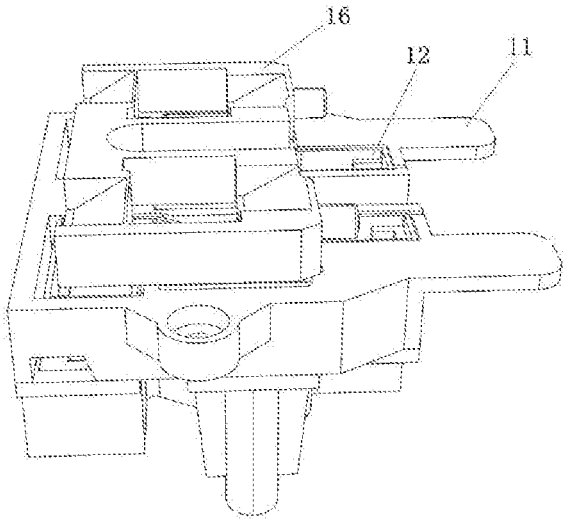
FIG. 5 is a diagram of the combination state of the children safety protection gate and the power socket of the present disclosure.

As shown in FIG. 1 to FIG. 4, a universal socket converter with power bank, includes a housing 1, wherein the front of the housing 1 is provided with a USB power jack 2, universal power jack 3 and indicator light 4, the upper and lower ends of the back of the housing 1 are respectively provided with retractable power-taking plug 5 and retractable power-taking plug 6, the middle part of the back of the housing 1 is provided with foldable power-taking plug 7; The inside of the housing 1 is provided with circuit board 8 and storage battery 9, wherein the circuit board 8 is provided with USB power socket 10 and integrated universal power socket 11, wherein the USB power socket 10 and the integrated universal power socket 11 are provided with conductor 12 inside, wherein the conductor 12 is connected with the circuit board 8, the circuit board 8 is connected with the storage battery 9, the retractable power-taking plug 5, the retractable power-taking plug 6 and the foldable power-taking plug 7; Built-in slider 13, located between the circuit board 8 and the housing 1, when one plug is pushed out, other plugs will be locked automatically and cannot be pushed out and moved to contact circuit; Built-in spring 14, located on the PC board 15. As shown in FIG. 5, the present disclosure is also provided with children safety protection gate 16 inside, wherein the children safety protection gate 16 is set above the integrated universal power socket 11, meanwhile the children safety protection gate 16 is located under the universal power jack 3. The universal power jacks 3 include British standard socket, Australian standard socket, European standard socket and American standard socket.

Figure 6:
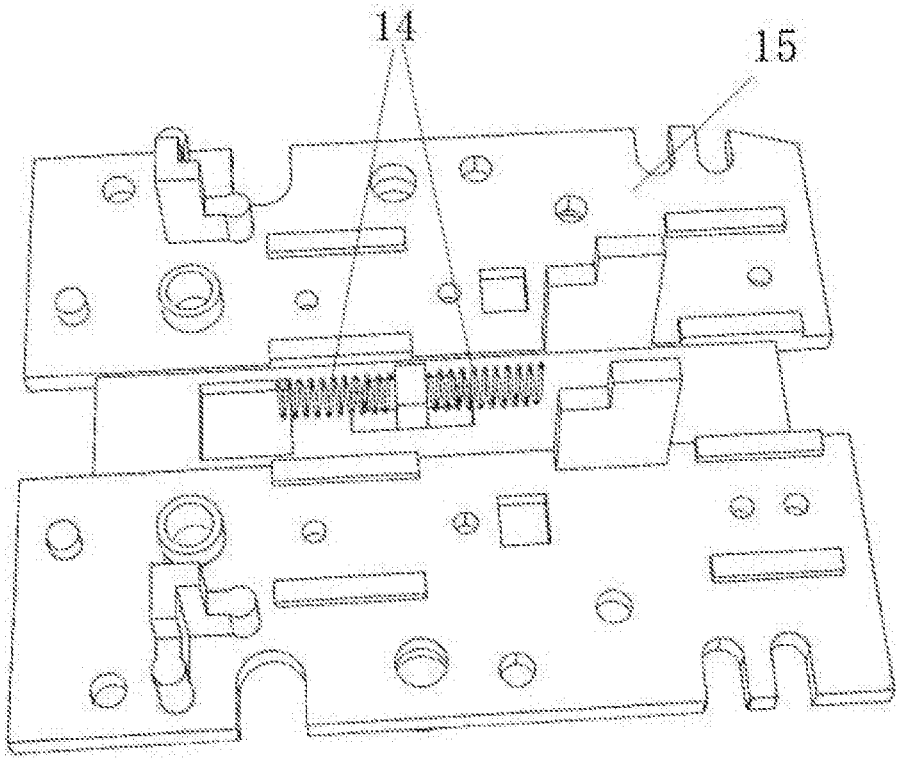
FIG. 6 is a diagram of the combination state of the spring and the PC board of the present disclosure.
Figure 7:
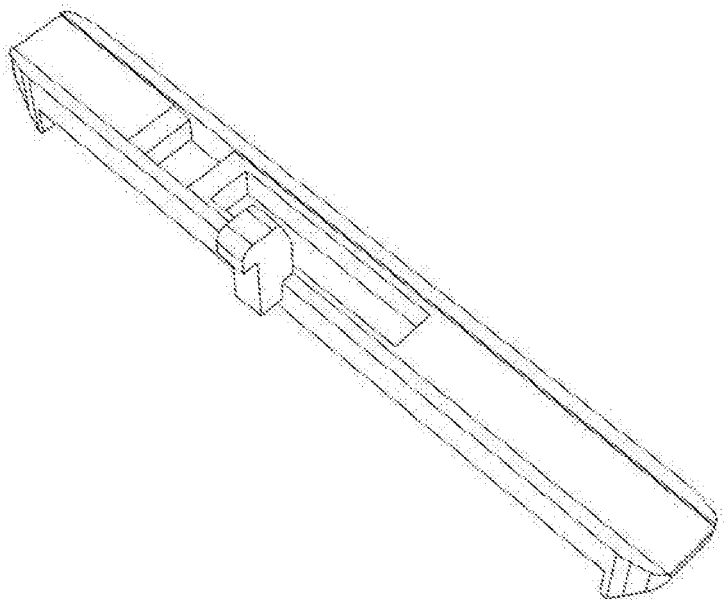
FIG. 7 is a diagram of the slider of the present disclosure.
Figure 8:
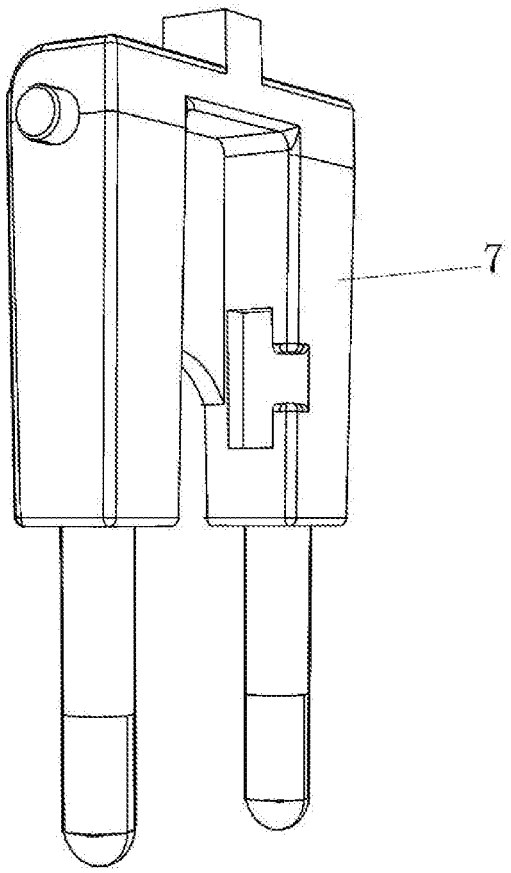
FIG. 8 is a diagram of the foldable power-taking plug of the present disclosure.

FIG. 6 is a diagram of the combination state of the spring and the PC board of the present disclosure. FIG. 7 is a diagram of the slider of the present disclosure. FIG. 8 is a diagram of the foldable power-taking plug of the present disclosure.

The retractable power-taking plug 5, the retractable power-taking plug 6 or the foldable power-taking plug 7 includes British standard plug, Australian standard plug and European standard plug.

The housing 1 is made from flame retardant material, wherein the flame retardant material is PC material.

The conductor 12 is made from brass.

The fuses are provided between the circuit board 8 and the retractable power-taking plug 5, the retractable power-taking plug 6 and the foldable power-taking plug 7.

There are two USB power jacks 2, one is 1.5 A, the other one is 2.1 A.

The retractable power-taking plug 5, the retractable power-taking plug 6, and the foldable power-taking plug 7 are all made from nickel plated copper; Built-in slider 13, when the retractable power-taking plug 5 or the retractable power-taking plug 6 is pushed out, the built-in slider 13 will move to lock other power-taking plugs automatically and so that they cannot be pushed out and moved to contact circuit, and when the foldable power-taking plug 7 is turned out, the built-in slider 13 will be locked and cannot move, so that the retractable power-taking plug 5 and the retractable power-taking plug 6 cannot be pushed out and moved to contact circuit; When the power-taking plug resets, the built-in slider 13 resets under the action of the spring 14. That is, only one power-taking plug can be used at a time, other power-taking plugs will be able to be used after resetting.

The foldable power-taking plug 7 is provided with a groove, when the retractable power-taking plug 5 or the retractable power-taking plug 6 is pushed out, built-in slider 13 will move and buckle in the groove to lock it.

The spring 14 acts on built-in slider 13 to reset it.

The circuit board 8 is provided with three smart ICs, used to prevent overcurrent, overcharge, overload, overvoltage, short circuit, and high temperature.

The present disclosure passed through the CE, ROSH, IC and FCC certification; The maximum supported current is 6.3 A, and it is safe and easy for daily low voltage electrical switch; It is designed with a wide scope of voltage 100~240V, and it has wider scope of application and is running more stable.

What mentioned above is only the embodiment of the present disclosure, it is not to limit the scope of the present disclosure. Any equivalent structures or equivalent flow transformations using the content of the instructions and drawings of the present disclosure, or direct or indirect applications in other related technical fields, are all similarly included within the scope of the patent protection of the present utility model.

What is claimed is:

1. A universal socket converter with power bank, comprising:

a housing, wherein a front of the housing is provided with a USB power jack, a universal power jack and an indicator light, an upper end and a lower end of a back of the housing are respectively provided with a retractable power-taking plug, a middle part of the back of the housing is provided with a foldable power-taking plug; an inside of the housing is provided with a circuit board and a storage battery, wherein the circuit board is provided with a USB power socket and an integrated universal power socket, wherein the USB power socket and the integrated universal power socket are provided with conductors inside, wherein the conductors are connected with the circuit board, the circuit board is connected with the storage battery, the retractable power-taking plug and the foldable power-taking plug.

2. The universal socket converter with power bank according to claim 1, wherein the universal socket converter with power bank also includes a built-in slider which is located between the circuit board and the housing, when the retractable power-taking plug is pushed out, another retractable power-taking plug will be locked so that cannot be pushed out and moved to a contact circuit.

3. The universal socket converter with power bank according to claim 1, wherein the universal power jacks include British standard socket, Australian standard socket, European standard socket and American standard socket.

4. The universal socket converter with power bank according to claim 1, wherein the power-taking plugs includes British standard plug, Australian standard plug and European standard plug.

5. The universal socket converter with power bank according to claim 1, wherein the conductor is made from brass.

6. The universal socket converter with power bank according to claim 1, wherein a fuse is set between the circuit board and the power-taking plug.

7. The universal socket converter with power bank according to claim 1, wherein there are two USB power jacks, one is 1.5 A, the other one is 2.1 A.

8. The universal socket converter with power bank according to claim 1, wherein the retractable power-taking plug or the foldable power-taking plug are made from nickel plated copper.

9. The universal socket converter with power bank according to claim 1, wherein the circuit board is provided with three smart ICs.

10. The universal socket converter with power bank according to claim 1, wherein the housing is made from flame retardant material.

11. The universal socket converter with power bank according to claim 10, wherein the flame retardant material is PC (Poly Carbonate) material.

* * * * *